US006665608B2

(12) United States Patent
Wakahara et al.

(10) Patent No.: US 6,665,608 B2
(45) Date of Patent: Dec. 16, 2003

(54) COOLANT TEMPERATURE ESTIMATION SYSTEM FOR ESTIMATING TEMPERATURE OF COOLANT OF INTERNAL COMBUSTION ENGINE

(75) Inventors: Keiji Wakahara, Inazawa (JP); Toshio Kondo, Kariya (JP)

(73) Assignee: Denso Corporation, Kariya (JP)

( * ) Notice: Subject to any disclaimer, the term of this patent is extended or adjusted under 35 U.S.C. 154(b) by 130 days.

(21) Appl. No.: 10/073,185

(22) Filed: Feb. 13, 2002

(65) Prior Publication Data

US 2002/0111734 A1 Aug. 15, 2002

(30) Foreign Application Priority Data

Feb. 15, 2001 (JP) ..... 2001-038081
Oct. 16, 2001 (JP) ..... 2001-317587

(51) Int. Cl.[7] ..... F01P 5/14; G06G 7/70
(52) U.S. Cl. ..... 701/114; 123/41.15; 73/118.1
(58) Field of Search ..... 123/41.01, 41.15, 123/198 D, 198 DB; 73/116, 117.3, 118.1; 701/101, 102, 103, 114, 115; 374/1, 145

(56) References Cited

U.S. PATENT DOCUMENTS 6,200,021 B1 * 3/2001 Mitsutani et al. ..... 374/145
6,240,774 B1 * 6/2001 Niki et al. ..... 73/118.1
6,279,390 B1 8/2001 Oka et al. ..... 73/118.1
6,302,065 B1 * 10/2001 Davison ..... 123/41.15
6,463,892 B1 * 10/2002 Russell ..... 123/41.15

FOREIGN PATENT DOCUMENTS

JP 2000-220456 8/2000

* cited by examiner

*Primary Examiner*—Willis R. Wolfe
(74) *Attorney, Agent, or Firm*—Nixon & Vanderhye P.C.

(57) ABSTRACT

Even after initiation of a fuel cutting operation, an estimated coolant temperature value is continuously renewed based on an engine operating state until a predetermined time period elapses. Thus, an increase in the coolant temperature during the fuel cutting operation can be estimated. Furthermore, overestimation of the increase in the coolant temperature during the fuel cutting operation can be avoided since the renewal of the estimated coolant temperature after the elapse of the predetermined time period is prohibited. In this way, possible deterioration of coolant temperature estimation accuracy caused by the fuel cutting operation can be minimized, allowing more accurate coolant temperature estimation. As a result, when abnormality of a thermostat is judged based on a difference between an actual coolant temperature and the estimated coolant temperature value, misjudgment of a normal thermostat as an abnormal thermostat can be prevented.

10 Claims, 7 Drawing Sheets

MAP3

| TIME tfc(sec) | 1 | 2 | 3 | 4 | 5 | 6 | 7 | 8 | 9 | 10 | .... |
|---|---|---|---|---|---|---|---|---|---|---|---|
| COEF. Kfc | 1 | 0.65 | 0.4 | 0.22 | 0.12 | 0 | 0 | 0 | 0 | 0 | 0 |

COOLANT TEMPERATURE ESTIMATION SYSTEM FOR ESTIMATING TEMPERATURE OF COOLANT OF INTERNAL COMBUSTION ENGINE

CROSS REFERENCE TO RELATED APPLICATION

This application is based on and incorporates herein by reference Japanese Patent Application No. 2001-38081 filed on Feb. 15, 2001 and Japanese Patent Application No. 2001-317587 filed on Oct. 16, 2001.

BACKGROUND OF THE INVENTION

1. Field of the Invention

The present invention relates to a coolant temperature estimation system of an internal combustion engine, which renews an estimated coolant temperature value based on an operating state of the engine during engine operation.

2. Description of Related Art

For example, Japanese Unexamined Patent Publication No. 2000-220456 proposes a malfunction detection system for detecting malfunction of a thermostat of an engine cooling system. In the malfunction detection system, an amount of heat generated from an engine, which corresponds to an operating state of the engine (the amount of air filled in the respective cylinders), is converted to an increase in coolant temperature at predetermined time intervals during the engine operation. Then, the increase in the coolant temperature is added to a previously estimated coolant temperature value to obtain a currently estimated coolant temperature value. Abnormality of the thermostat is judged by determining whether a difference between the currently estimated coolant temperature value and an actual coolant temperature measured with a coolant temperature sensor is greater than an abnormality judgment threshold value.

Generally, an engine installed in a vehicle cuts fuel supply to stop fuel injection during a vehicle speed reducing period and also during a high engine speed period in order to improve fuel consumption during the vehicle speed reducing period and to prevent engine damage during the high engine speed period. During the fuel cutting operation, heat of combustion is not generated in the engine, and thus it is assumed that a coolant temperature is reduced through heat release from the coolant during the fuel cutting operation in the above system. As a result, in the above system, the estimated coolant temperature value is gradually reduced during the fuel cutting operation as a function of time elapsed since the initiation of the fuel cutting operation.

However, one recent experimental result indicates that the coolant temperature value continues to increase for a while even after the initiation of the fuel cutting operation. This is probably due to the following two reasons. Firstly, even during the fuel cutting operation, the intake air supplied to the respective cylinders of the engine is compressed therein, so that the heat of compression is generated in the respective cylinders. Secondly, the cylinder block temperature is higher than the coolant temperature during the engine operation, so that the heat accumulated in the cylinder block is conducted to the coolant to increase the coolant temperature during the fuel cutting operation.

Thus, if the estimated coolant temperature value is gradually reduced during the fuel cutting operation as a function time elapsed since the initiation of the fuel cutting operation, as in the case of the above system, a difference between the estimated coolant temperature value and the actual coolant temperature is increased during the fuel cutting operation. This causes deterioration of estimation accuracy of the coolant temperature. As a result, a normal thermostat could possibly be mistakenly judged as abnormal.

SUMMARY OF THE INVENTION

The present invention addresses the above disadvantages. Thus, it is an objective of the present invention to provide a coolant temperature estimation system of an internal combustion engine capable of minimizing deterioration of coolant temperature estimation accuracy induced by a fuel cutting operation and also capable of achieving more reliable coolant temperature estimation.

To achieve the objective of the present invention, there is provided a coolant temperature estimation system for estimating a temperature of coolant of an internal combustion engine. The system includes a coolant temperature estimating means and a coolant temperature estimation prohibiting means. The coolant temperature estimating means renews an estimated coolant temperature value based on an operating state of the internal combustion engine during operation of the internal combustion engine. The coolant temperature estimation prohibiting means prohibits renewal of the estimated coolant temperature value upon elapse of a predetermined time period since initiation of a fuel cutting operation until end of the fuel cutting operation.

To achieve the objective of the invention, the system can alternatively include an estimated coolant temperature correcting means in place of the coolant temperature estimation prohibiting means. The estimated coolant temperature correcting means corrects the estimated coolant temperature value in such a manner that an increase in the estimated coolant temperature value is progressively reduced as a function of time elapsed since the initiation of the fuel cutting operation during the fuel cutting operation.

Furthermore, to achieve the objective of the present invention, there may be alternatively provided a coolant temperature estimation system for estimating a temperature of coolant of an internal combustion engine. The system includes a coolant temperature estimating means. The coolant temperature estimating means renews an estimated coolant temperature value based on an operating state of the internal combustion engine during operation of the internal combustion engine. The coolant temperature estimating means includes a fuel cutting period coolant temperature estimating means, which computes the estimated coolant temperature value during a fuel cutting operation. The fuel cutting period coolant temperature estimating means is selected and used during the fuel cutting operation to renew the estimated coolant temperature value in such a manner that an increase in the estimated coolant temperature value during the fuel cutting operation is reduced in comparison to an increase in the estimated coolant temperature value during a normal operation.

BRIEF DESCRIPTION OF THE DRAWINGS

The invention, together with additional objectives, features and advantages thereof, will be best understood from the following description, the appended claims and the accompanying drawings in which:

Figure 1:
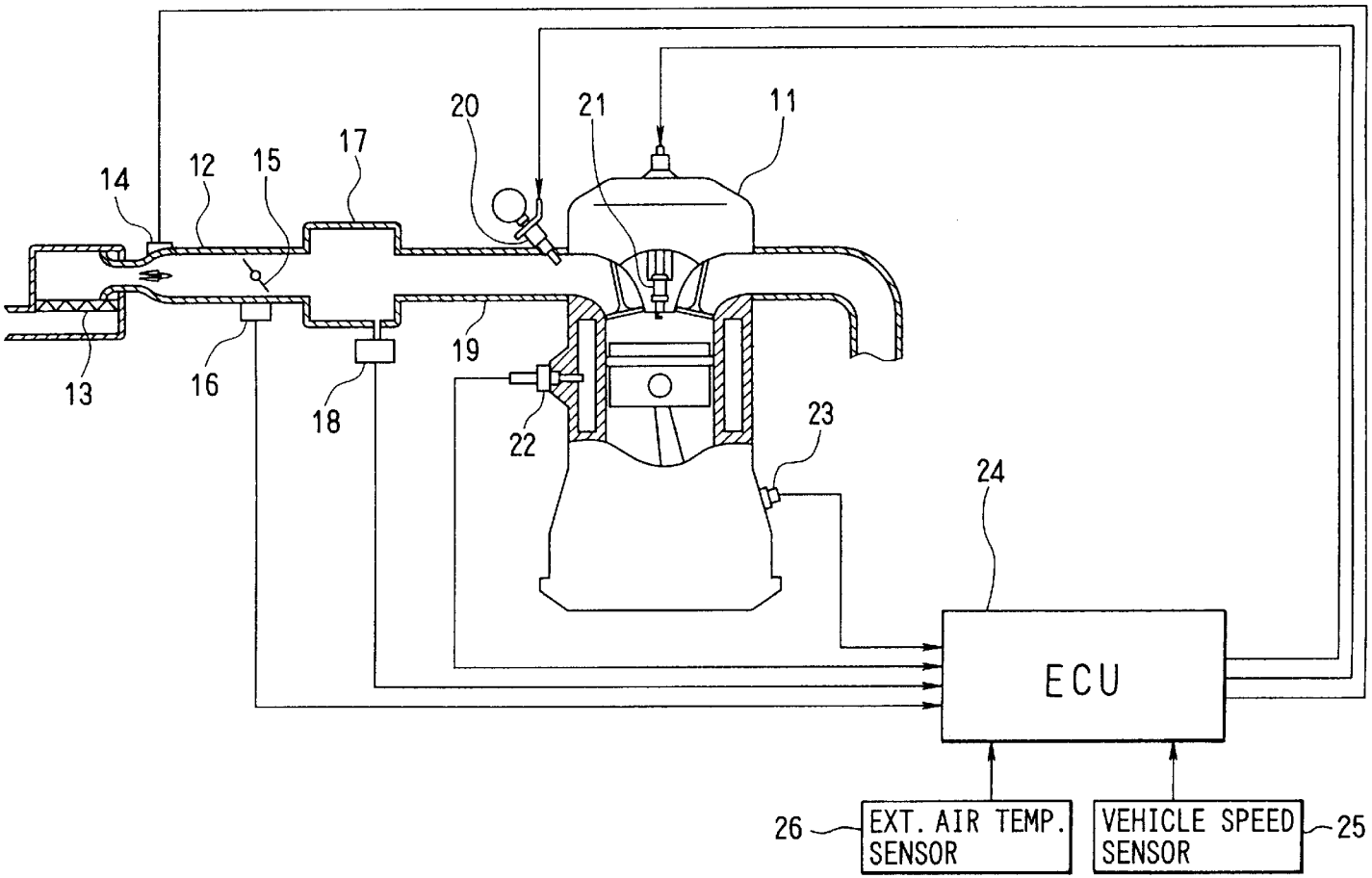
FIG. 1 is a schematic diagram showing an engine control system according to a first embodiment of the present invention.

DETAILED DESCRIPTION OF THE INVENTION (First Embodiment)

A first embodiment of the present invention will be described with reference to FIGS. 1 to 4. A structure of an engine control system will be briefly described with reference to FIG. 1. An air cleaner 13 is arranged at an uppermost stream end of an intake pipe 12 of an engine 11, i.e., an internal combustion engine. An air flow meter 14 for measuring an amount of intake air is arranged downstream of the air cleaner 13 in the intake pipe 12. A throttle valve 15 is arranged downstream of the air flow meter 14. Position (throttle valve position) of the throttle valve 15 is measured with a throttle valve position sensor 16.

A surge tank 17 is arranged downstream of the throttle valve 15 in the intake pipe 12. An intake pipe pressure sensor 18 for measuring an intake pipe pressure (i.e., the pressure inside the intake pipe 12) Pm is attached to the surge tank 17. An intake manifold 19 for conducting air to each cylinder of the engine 11 is connected to the surge tank 17. A fuel injection valve 20 is provided in the intake manifold 19 near a corresponding intake port of each cylinder. In a cylinder head of the engine 11, a spark plug 21 is provided to each cylinder. A coolant temperature sensor 22 for measuring a coolant temperature Thw and a crank angle sensor 23 for measuring an engine speed Ne are arranged in a cylinder block of the engine 11.

Furthermore, a vehicle speed sensor 25 for measuring a vehicle speed SPD and an external air temperature sensor 26 for measuring an external air temperature Tout are arranged in a vehicle.

These various sensor outputs are fed to an engine control circuit (hereinafter, simply referred to as "ECU") 24. The ECU 24 includes a microcomputer and executes various control programs stored in an internal ROM (memory) to control a fuel injection amount of the fuel injection valve 20, ignition timing of the spark plug 21 and the like based on the engine operating state.

Figure 2:
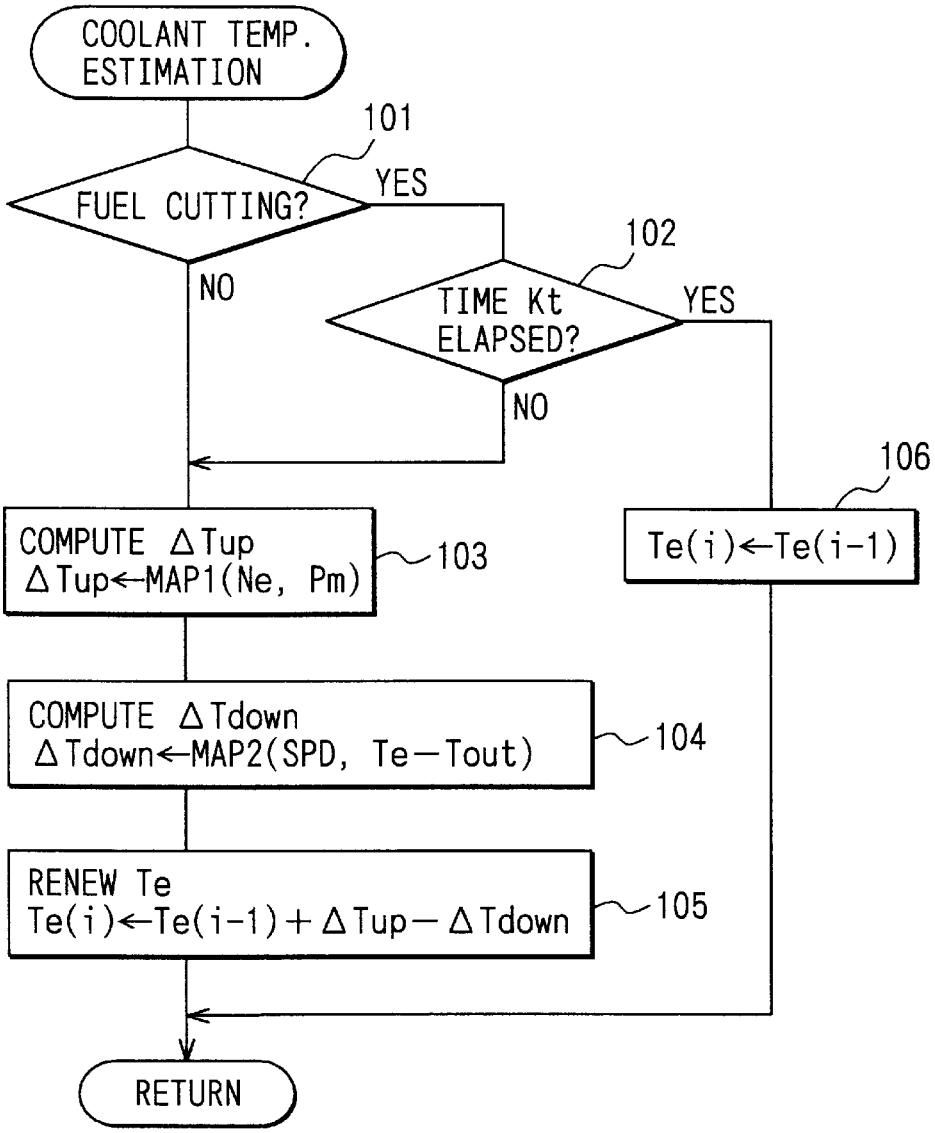
FIG. 2 is a flow chart showing a coolant temperature estimation program according to the first embodiment.

The ECU 24 executes a coolant temperature estimation program depicted in FIG. 2 at predetermined time intervals during the engine operation. Upon execution of the coolant temperature estimation program, an estimated coolant temperature value Te is renewed based on the engine operating parameters, such as the engine speed Ne, the intake pipe pressure Pm, the vehicle speed SPD and the external air temperature Tout, at predetermined time intervals during the engine operation. Furthermore, the ECU 24 executes a thermostat abnormality judgment program depicted in FIG. 3 at predetermined time intervals during the engine operation. Upon execution of this program, when a predetermined abnormality judgment executable condition is satisfied, abnormality of the thermostat is judged by determining whether a difference (error) between the actual coolant temperature Thw (measured value of the coolant temperature sensor 22) and the estimated coolant temperature value Te, which is estimated through the coolant temperature estimation program depicted in FIG. 2, is greater than a predetermined abnormality judgment threshold value. Operation of each program described above will be described below.

The coolant temperature estimation program depicted in FIG. 2 is executed at the predetermined time intervals (e.g., every one second) during the engine operation and acts as a coolant temperature estimating means, which renews or updates the estimated coolant temperature value Te. When this program is executed, it is first determined whether a fuel cutting operation is currently carried out at step 101. If the fuel cutting operation is not currently carried out, control proceeds to step 103. At step 103, a net coolant temperature increase ΔTup is computed using a two dimensional map MAP1 based on the engine operating parameters, such as the engine speed Ne and the intake pipe pressure Pm, which are relevant to the amount of the heat generated from the engine 11 (i.e., the amount of the heat conducted to the coolant from the engine 11). The net coolant temperature increase ΔTup is the net coolant temperature increase, which is estimated based on the amount of the heat generated from the engine 11 under assumption that there is no temperature decrease in the coolant through heat release therefrom. The two dimensional map MAP1 is constructed in such a manner that the greater the amount of the heat generated from the engine 11, the greater the net coolant temperature increase ΔTup.

The parameters of the map MAP1 for computing the net coolant temperature increase ΔTup are not limited to the engine speed Ne and the intake pipe pressure Pm. For example, the engine operating parameters, such as the amount of the intake air and the throttle valve position, which are relevant to an amount of the intake air filled in the respective cylinders, can be used as the parameters of the map MAP1 for computing the net coolant temperature increase ΔTup. That is, it is only required to use the engine operating parameters relevant to the amount of the heat generated from the engine 11 (the amount of the heat conducted to the coolant from the engine 11). Furthermore, the number of the parameters of the map MAP1 for computing the net coolant temperature increase ΔTup is not limited to the two and can be one or three or even more.

Once the net coolant temperature increase ΔTup is computed, control moves to step 104. At step 104, a net coolant temperature decrease ΔTdown is computed using a two dimensional map MAP2 based on the engine operating parameters, such as the vehicle speed SPD and a temperature difference (Te−Tout) between the estimated coolant temperature value Te and the external air temperature Tout, which are relevant to an amount of heat released from the coolant. The net coolant temperature decrease ΔTdown is the net coolant temperature decrease induced by heat release from the coolant to wind (or air flow) applied to a running vehicle or wind generated by a radiator fan (not shown). The two dimensional map MAP2 is constructed in such a manner that the net coolant temperature decrease ΔTdown becomes greater as the vehicle speed SPD (i.e., the amount of the wind applied to the running vehicle) increases, and also the net coolant temperature decrease ΔTdown becomes greater as the temperature difference (Te−Tout) between the estimated coolant temperature value Te and the external air temperature value Tout increases.

Alternative to the difference (Te−Tout) between the estimated coolant temperature value Te and the external air temperature Tout, a temperature difference (Thw−Tout) between the actual coolant temperature Thw measured with the coolant temperature sensor 22 and the external air temperature Tout can be used as the parameter of the two dimensional map MAP2. Furthermore, an intake air temperature can be used in place of the external air temperature Tout. The number of the parameters of the map MAP2 is not limited to the two and can be one or three or even more.

Once the net coolant temperature decrease ΔTdown is computed, control moves to step 105. At step 105, a currently estimated coolant temperature value Te(i) is obtained by adding the net coolant temperature increase ΔTup to the previously estimated coolant temperature value Te(i−1) and then subtracting the net coolant temperature decrease ΔTdown from the sum of the previously estimated coolant temperature value Te(i−1) and the net coolant temperature increase ΔTup through the following equation.

$$Te(i)=Te(i-1)+\Delta Tup-\Delta Tdown$$

If it is determined that the fuel cutting operation is currently carried out at step 101, control moves to step 102. At step 102, it is determined whether a predetermined time period Kt has elapsed since the initiation of the fuel cutting operation. If the predetermined time period Kt has not elapsed, the above described steps 103–105 are carried out to renew the estimated coolant temperature value Te based on the engine operating parameters, such as the engine speed Ne, the intake pipe pressure Pm, the vehicle speed SPD and the external air temperature Tout, in a manner similar to that discussed above.

Thereafter, when the predetermined time period Kt has elapsed since the initiation of the fuel cutting operation during the fuel cutting operation, "YES" is returned at step 102, and the renewal of the estimated coolant temperature value Te (operations at steps 103 to 105) is prohibited. Thereafter, the renewal of the estimated coolant temperature value Te is prohibited until the fuel cutting operation is terminated. During this renewal prohibition period, the estimated coolant temperature value Te is maintained at the value computed right before the renewal prohibition period (step 106). The operations of steps 102, 106 achieve a role of a coolant temperature estimation prohibiting means of the present invention.

Thereafter, upon termination of the fuel cutting operation, "No" is returned at step 101, and the operations of the above described steps 103–105 are carried out. Thus, the estimated coolant temperature value Te is renewed based on the engine operating parameters, such as the engine speed Ne, the intake pipe pressure Pm, the vehicle speed SPD and the outside temperature Tout.

Figure 3:
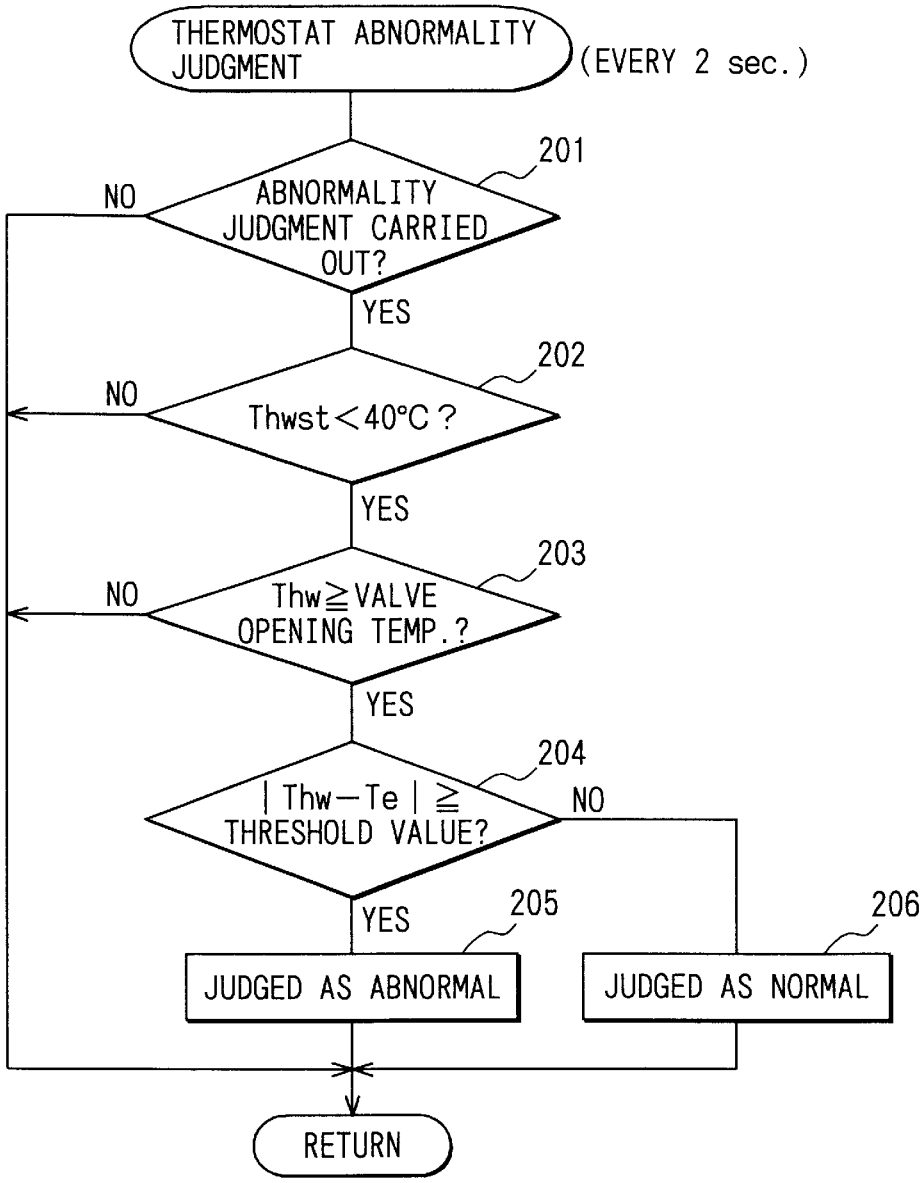
FIG. 3 is a thermostat abnormality judgment program according to the first embodiment.

A thermostat abnormality judgment program shown in FIG. 3 is executed at predetermined time intervals (e.g., at every two seconds) during the engine operation and achieves a role of an abnormality detecting means of the present invention. When this program is executed, it is determined whether the predetermined abnormality judgment executable condition is satisfied at steps 201–203. In this embodiment, the abnormality judgment executable condition is satisfied upon satisfaction of the following all three conditions (1)–(3).

(1) The abnormality judgment of the thermostat has not been carried out during the current engine operation (step 201).

(2) A coolant temperature Thwst at time of engine start is sufficiently lower than a thermostat valve opening temperature, e.g., equal to or below 40 degrees Celsius (step 202).

(3) The actual coolant temperature Thw measured with the coolant temperature sensor 22 is increased equal to or above the thermostat valve opening temperature, e.g., equal to or above 90 degrees Celsius (step 203).

If any one of the above three conditions (1)–(3) is not satisfied, the abnormality judgment executable condition is not satisfied. Thus, the program is terminated without judging the abnormality of the thermostat.

On the other hand, if the above all three conditions (1)–(3) are satisfied, the abnormality judgment executable condition is satisfied. That is, in the case where the coolant temperature Thwst at the time of engine start is sufficiently lower than the thermostat valve opening temperature (e.g., equal to or below 40 degrees Celsius), the abnormality judgment executable condition is satisfied right after the actual coolant temperature Thw measured with the coolant temperature sensor 22 reaches the thermostat valve opening temperature (e.g., 90 degrees Celsius), so that control moves to step 204. At step 204, it is determined whether the thermostat is abnormal by determining whether the difference between the actual coolant temperature Thw measured with the coolant temperature sensor 22 and the estimated coolant temperature value Te estimated through the coolant temperature estimation program shown in FIG. 2 is equal to or greater than the abnormality judgment threshold value (e.g., 10 degrees Celsius).

At this time, if the difference between the actual coolant temperature Thw and the estimated coolant temperature value Te is smaller than the abnormality judgment threshold value, the thermostat is judged or determined as normal. On the other hand, if the difference between the actual coolant temperature Thw and the estimated coolant temperature value Te is equal to or greater than the abnormality judgment threshold value, the thermostat is judged or determined as abnormal. Thus, a warning lamp (not shown) provided in an instrument panel at a driver seat side is lit or is flashed to provide a warning to the driver, and information indicative of the thermostat abnormality is stored in a backup RAM (not shown) of the ECU 24.

Advantages of the first embodiment will be described with reference to FIG. 4. An exemplary time chart shown in FIG. 4 indicates exemplary behavior of the estimated coolant temperature value Te and exemplary behavior of the actual coolant temperature Thw during the fuel cutting operation according to the first embodiment. Furthermore, in the time chart of FIG. 4, as a comparative example, behavior of an estimated coolant temperature value, which is obtained while the renewal of the estimated coolant temperature value is prohibited throughout the fuel cutting operation, is indicated with a dotted line.

Figure 4:
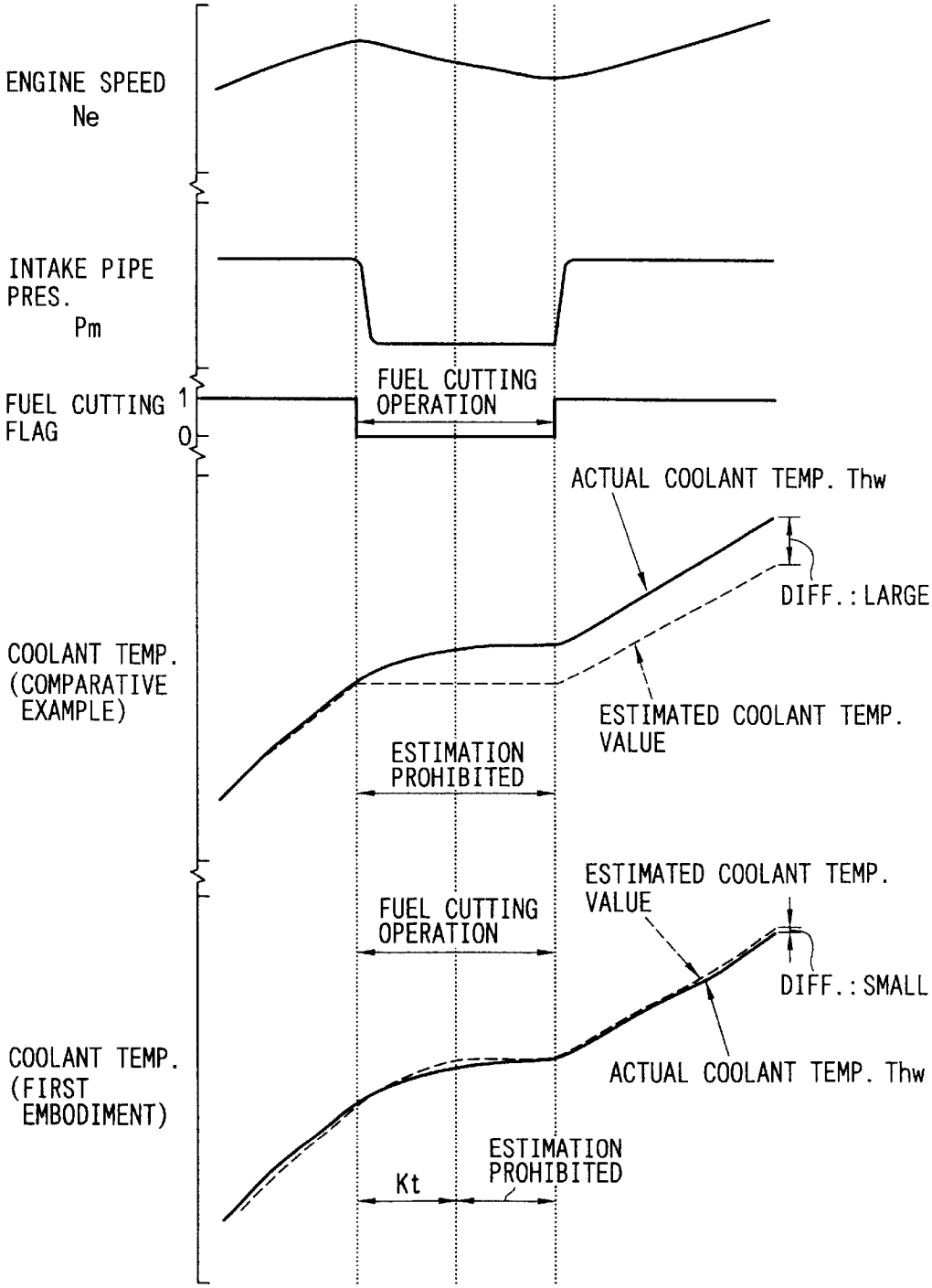
FIG. 4 is a time chart showing changes in an engine speed, an intake pipe pressure, an estimated coolant temperature value and an actual coolant temperature value.

As shown in FIG. 4, even during the fuel cutting operation, the actual coolant temperature Thw continues to increase for a while after the initiation of the fuel cutting operation. This is probably due to the following two reasons. Firstly, even during the fuel cutting operation, the intake air supplied to the respective cylinders of the engine 11 is compressed therein, so that the heat of compression is generated in the respective cylinders. Secondly, the cylinder block temperature is higher than the coolant temperature during the engine operation, so that the heat accumulated in the cylinder block is conducted to the coolant to increase the coolant temperature even during the fuel cutting operation.

Thus, as in the case of the comparative example, when the estimated coolant temperature value is kept constant during the fuel cutting operation by prohibiting the renewal of the estimated coolant temperature value right after the initiation of the fuel cutting operation, or when the estimated coolant temperature value is gradually reduced during the fuel cutting operation as a function of time elapsed since the initiation of the fuel cutting operation in a manner described, for example, in Japanese Unexamined Patent Publication No. 2000-220456, the difference between the actual coolant temperature value and the estimated coolant temperature value increases with time after the initiation of the fuel cutting operation. Thus, at the end of the fuel cutting operation, the difference between the actual coolant temperature value and the estimated coolant temperature value becomes relatively large.

As a result, the estimated difference, which is once increased during the fuel cutting operation, may not be substantially reduced even when the renewal of the estimated coolant temperature value is resumed after the fuel cutting operation. Thereafter, when the abnormality judgment executable condition is satisfied, and thus the abnormality of the thermostat is judged based on the difference between the actual coolant temperature Thw and the estimated coolant temperature value Te, a normal thermostat could possibly be mistakenly judged as abnormal.

On the other hand, according to the first embodiment of the present invention, even after the initiation of the fuel cutting operation, the estimated coolant temperature value Te is continuously renewed based on the engine operating state until the predetermined time period Kt elapses. Thus, the increase in the coolant temperature during the fuel cutting operation can be estimated. Furthermore, overestimation of the increase in the coolant temperature during the fuel cutting operation can be avoided since the renewal of the estimated coolant temperature Te after the elapse of the predetermined time period Kt is prohibited. In this way, possible deterioration of the coolant temperature estimation accuracy caused by the fuel cutting operation can be minimized, allowing more accurate coolant temperature estimation. As a result, when the abnormality of the thermostat is judged based on the difference between the actual coolant temperature Thw and the estimated coolant temperature value Te, misjudgment of the normal thermostat as the abnormal thermostat can be restrained, allowing improvement of the thermostat judgment reliability.

In this case, upon evaluating characteristics of the increase in the coolant temperature during the fuel cutting operation through experiments and simulations, an average time period between the initiation of the fuel cutting operation and the end of substantial increase of the coolant temperature (i.e., the average time period during which the coolant temperature continues to increase) can be used as the predetermined time period Kt between the initiation of the fuel cutting operation and the prohibition of the renewal of the estimated coolant temperature value Te.

Characteristics of the increase in the coolant temperature during the fuel cutting operation vary depend on the engine temperature (the amount of the heat conducted from the cylinder block to the coolant) and the vehicle speed SPD (the amount of the heat taken away by the wind applied to the running vehicle). For example, the amount of the heat in the cylinder block increases as the engine temperature increases. Thus, the time period, during which the coolant temperature continues to increase in the fuel cutting operation, is increased as the engine temperature increases. Furthermore, the amount of the heat taken away by the wind applied to the running vehicle increases as the vehicle speed SPD increases. Thus, the time period, during which the coolant temperature continues to increase in the fuel cutting operation, is reduced as the vehicle speed SPD increases.

Based on the above point, the predetermined time period Kt between the initiation of the fuel cutting operation and the prohibition of the renewal of the estimated coolant temperature value Te (i.e., the predetermined time period Kt, during which the renewal of the estimated coolant temperature value Te continues after the initiation of the fuel cutting operation) can be determined and set based on the engine temperature and/or the vehicle speed SPD through a map or a formula. In this manner, based on the amount of the heat conducted from the cylinder block to the coolant during the fuel cutting operation or the amount of the heat taken away by the wind applied to the running vehicle, the predetermined time period Kt, during which the renewal of the estimated coolant temperature value Te continues after the initiation of the fuel cutting operation, can be appropriately determined and set. As a result, the coolant temperature estimation accuracy can be improved in comparison to a case where the predetermined time period Kt is a fixed value.

In the above instance, the engine temperature can be measured directly with a temperature sensor. Alternatively, in order to avoid an increase in the number of the sensors installed in the vehicle (i.e., in order to avoid an increase in the manufacturing cost), the engine temperature can be estimated based on at least one of available relevant temperature values, such as the actual coolant temperature Thw, the estimated coolant temperature value Te, the external air temperature Tout, the intake air temperature and the engine oil temperature.

In the first embodiment, after the initiation of the fuel cutting operation, the estimated coolant temperature value Te is renewed under the same conditions as those before the initiation of the fuel cutting operation until the predetermined time period Kt elapses. However, based on the fact that the increase in the coolant temperature is gradually reduced as a function of time elapsed since the initiation of the fuel cutting operation, the estimated coolant temperature Te can be corrected or modified in such a manner that an increase in the estimated coolant temperature Te is gradually or progressively reduced as a function of time elapsed since the initiation of the fuel cutting operation.

(Second Embodiment)

Figure 5:
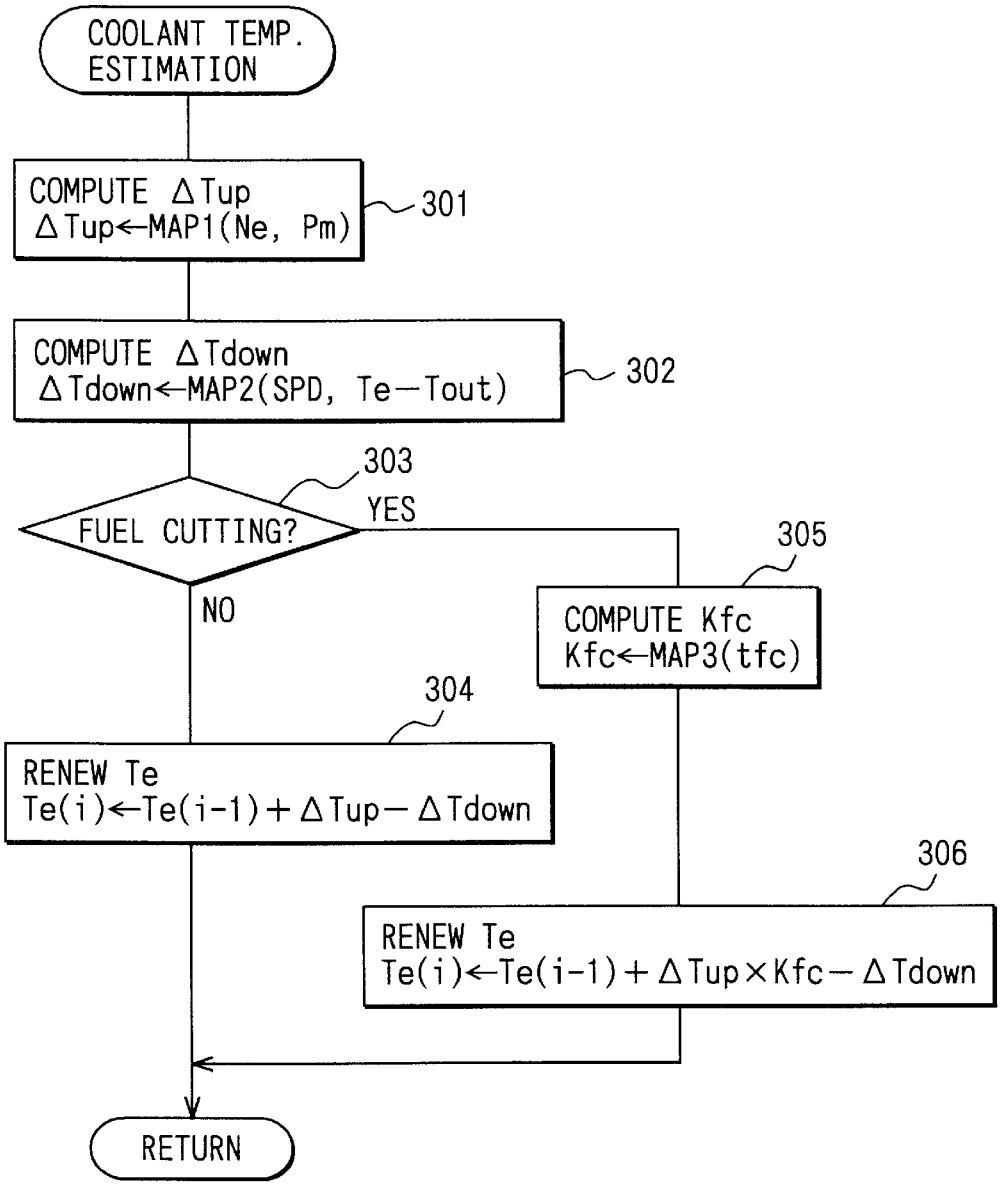
FIG. 5 is a flow chart showing a coolant temperature estimation program according to a second embodiment of the present invention.

In a second embodiment of the present invention, the estimated coolant temperature Te is renewed by executing a coolant temperature estimation program shown in FIG. 5. This program is executed at predetermined time intervals (e.g., every 1 second) during the engine operation. First, at step 301, the net coolant temperature increase ΔTup is computed using the two dimensional map MAP1 based on the engine operating parameters, such as the engine speed Ne and the intake pipe pressure Pm, which are relevant to the amount of the heat generated from the engine 11 (i.e., the amount of the heat conducted to the coolant from the engine 11). Then, control moves to step 302. At step 302, the net coolant temperature decrease ΔTdown is computed using the two dimensional map MAP2 based on the engine operating parameters, such as the vehicle speed SPD and the temperature difference (Te−Tout) between the estimated coolant temperature value Te and the external air temperature Tout, which are relevant to the amount of the heat released from the coolant.

Thereafter, control moves to step 303 where it is determined whether the fuel cutting operation is currently carried out. If it is determined that the fuel cutting operation is not currently carried out at step 303, control moves to step 304. At step 304, the currently estimated coolant temperature value Te(i) is obtained by adding the net coolant temperature increase ΔTup to the previously estimated coolant temperature value Te(i−1) and then subtracting the net coolant temperature decrease ΔTdown from the sum of the previously estimated coolant temperature value Te(i−1) and the net coolant temperature increase ΔTup through the following equation.

$$Te(i)=Te(i-1)+\Delta Tup-\Delta Tdown$$

It should be understood that the computation of the net coolant temperature increase ΔTup and the computation of the net coolant temperature decrease ΔTdown can be modified, as discussed with reference to the first embodiment.

If it is determined that the fuel cutting operation is currently carried out at step 303, control moves to step 305. At step 305, a correction coefficient Kfc is determined and set based on elapsed time tfc, which has elapsed since the initiation of the fuel cutting operation, with reference to a map MAP3 shown in FIG. 6. The increase in the coolant temperature is gradually reduced as the elapsed time period tfc, which has elapsed since the initiation of the fuel cutting operation, is increased. Based on this fact, the correction coefficient Kfc is provided as a coefficient for correcting the net coolant temperature increase ΔTup during the fuel cutting operation. Thus, the map MAP 3 of the correction coefficient Kfc is constructed in such a manner that the correction coefficient Kfc gradually decreases as the time tfc elapsed since the initiation of the fuel cutting operation increases, and the correction coefficient Kfc becomes zero when the elapsed time tfc exceeds a predetermined time period (e.g., 6 seconds).

After the correction coefficient Kfc is set, control moves to step 306. At step 306, the currently estimated coolant temperature value Te(i) is obtained by adding the corrected net coolant temperature increase ΔTup, which is corrected with the correction coefficient Kfc, to the previously estimated coolant temperature value Te(i−1) and then subtracting the net coolant temperature decrease ΔTdown from the sum of the previously estimated coolant temperature value Te(i−1) and the corrected net coolant temperature increase ΔTup through the following equation.

$$Te(i)=Te(i-1)+\Delta Tup\times Kfc-\Delta Tdown$$

Thereafter, when the fuel cutting operation ends, "NO" is returned at step 303, and thereby the correction of the estimated coolant temperature value Te is terminated. Then, the currently estimated coolant temperature value Te(i) is obtained by adding the net coolant temperature increase ΔTup to the previously estimated coolant temperature value Te(i−1) and then subtracting the net coolant temperature decrease ΔTdown from the sum of the previously estimated coolant temperature value Te(i−1) and the net coolant temperature increase ΔTup (step 304).

According to the second embodiment of the present invention, during the fuel cutting operation, the correction is made such that the increase ΔTup of the estimated coolant temperature value Te is gradually reduced as a function of the time elapsed since the initiation of the fuel cutting operation. Thus, the characteristics of the increase in the estimated coolant temperature value Te during the fuel cutting operation can be corrected to coincide with the characteristics of the increase in the actual coolant temperature. As a result, the coolant temperature estimation accuracy during the fuel cutting operation is further improved in comparison to that of the first embodiment.

Furthermore, according to the second embodiment, when the time tfc, which has elapsed since the initiation of the fuel cutting operation, exceeds the predetermined time (e.g., 6 seconds), the correction coefficient Kfc becomes zero. Thereafter, the currently estimated coolant temperature value Te(i) is renewed at the predetermined time intervals by subtracting the net coolant temperature decrease ΔTdown from the previously estimated coolant temperature value Te(i−1). Thus, once the time tfc, which has elapsed since the initiation of the fuel cutting operation, exceeds the predetermined time (e.g., 6 seconds), the estimated coolant temperature value Te is gradually decreased upon taking account of the heat release from the coolant. As a result, in a case of driving on a long downgrade, for example, in a mountain drive route where the fuel cutting operation continues for a relatively long period of time at the time of vehicle speed reduction, a relatively good coolant temperature estimation accuracy can be maintained during the fuel cutting operation.

Furthermore, according to the second embodiment, the correction coefficient Kfc for the net coolant temperature increase ΔTup during the fuel cutting operation is determined and set using the unidimensional map, in which the time tfc elapsed since the initiation of the fuel cutting operation is used as the parameter. However, the correction coefficient Kfc can be determined and set using a two or higher dimensional map, in which in addition to the time tfc elapsed since the initiation of the fuel cutting operation, at least one of the engine temperature, the vehicle speed SPD and the temperature difference between the coolant temperature and the external air temperature (intake air temperature) is used as an additional parameter.

Furthermore, according to the second embodiment, the net coolant temperature increase ΔTup measured during the fuel cutting operation is corrected with the correction coefficient Kfc to correct the estimated coolant temperature value. However, the estimated coolant temperature value, which is estimated under the same conditions as those of the normal operation during the fuel cutting operation, can be corrected with a corresponding correction coefficient.

(Third Embodiment)

Figures 6, 7:
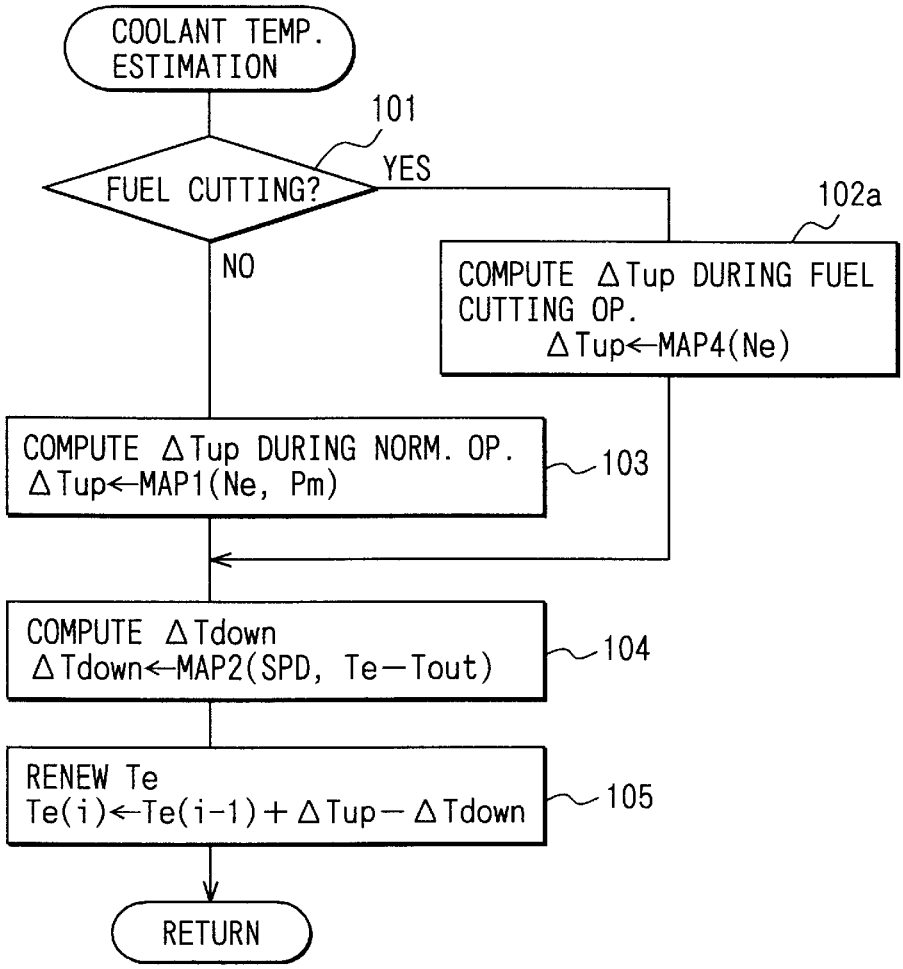
FIG. 6 is a diagram showing an exemplary map used for setting a correction coefficient based on time elapsed since initiation of a fuel cutting operation.
FIG. 7 is a flow chart showing a coolant temperature estimation program according to a third embodiment of the present invention.

According to a third embodiment of the present invention, the estimated coolant temperature value Te is renewed by executing a coolant temperature estimation program shown in FIG. 7. The coolant temperature estimation program of FIG. 7 is similar to that of the coolant temperature estimation program discussed in the first embodiment with reference to FIG. 2 except that steps 102 and 106 are replaced with step 102*a*.

According to the third embodiment, besides the normal operating period map MAP1, which is use in the normal operation, a fuel cutting period map MAP4, which is used in the fuel cutting operation, is stored in the ROM (memory) of the ECU 24 as a map used for computing the net coolant temperature increase ΔTup. If it is determined that the fuel cutting operation is not currently carried out at step 101, control moves from step 101 to step 103. At step 103, similar to the first embodiment, the net coolant temperature increase ΔTup during the normal operation is computed using the normal operating period map MAP1 based on the engine operating parameters, such as the engine speed Ne and the intake pipe pressure Pm, which are relevant to the amount of the heat generated from the engine 11.

On the other hand, if it is determined that the fuel cutting operation is currently carried out at step 101, control moves from step 101 to step 102*a*. At step 102*a*, the fuel cutting period map MAP4 is selected, and the net coolant temperature increase ΔTup during the fuel cutting operation is computed based on the engine operating parameter, such as the engine speed Ne, which is relevant to the heat of the compression of the air generated in the respective cylinders of the engine 11. In this case, besides the engine speed Ne, at least one of the engine operating parameters, such as the amount of the intake air, the intake pipe pressure Pm and the throttle valve position, which are relevant to the amount of the intake air filled in the respective cylinders, can be used as the parameter of the fuel cutting period map MAP 4. In essence, it is only required to use at least one engine operating parameter, which is relevant to the heat of the compression of the air generated in the respective cylinders of the engine 11 during the fuel cutting operation. The operation at step 102*a* achieves a role of a fuel cutting period coolant temperature estimating means of the present invention.

After the net coolant temperature increase ΔTup is computed at step 103 or 102*a* as described above, control moves to step 104. At step 104, similar to the first embodiment, the net coolant temperature decrease ΔTdown is computed using the two dimensional map MAP2 based on the vehicle speed SPD and the temperature difference (Te−Tout) between the estimated coolant temperature value Te and the external air temperature Tout. Then, control moves to step 105. At step 105, the currently estimated coolant temperature value Te(i) is obtained by adding the net coolant temperature increase ΔTup to the previously estimated coolant temperature value Te(i−1) and then subtracting the net coolant temperature decrease ΔTdown from the sum of the previously estimated coolant temperature value Te(i−1) and the net coolant temperature increase ΔTup.

In the third embodiment, the fuel cutting period map MAP4 is selected and used during the fuel cutting operation, and the net coolant temperature increase ΔTup during the fuel cutting operation is computed based on the engine operating parameter (engine speed Ne), which is relevant to the heat of the compression of the air in the respective cylinders of the engine 11 during the fuel cutting operation. Thus, similar to the second embodiment, the characteristics of the increase in the estimated coolant temperature Te during the fuel cutting operation coincide with the characteristics of the increase in the actual coolant temperature. As a result, the coolant temperature estimation accuracy during the fuel cutting operation can be improved.

(Fourth Embodiment)

Figure 8:
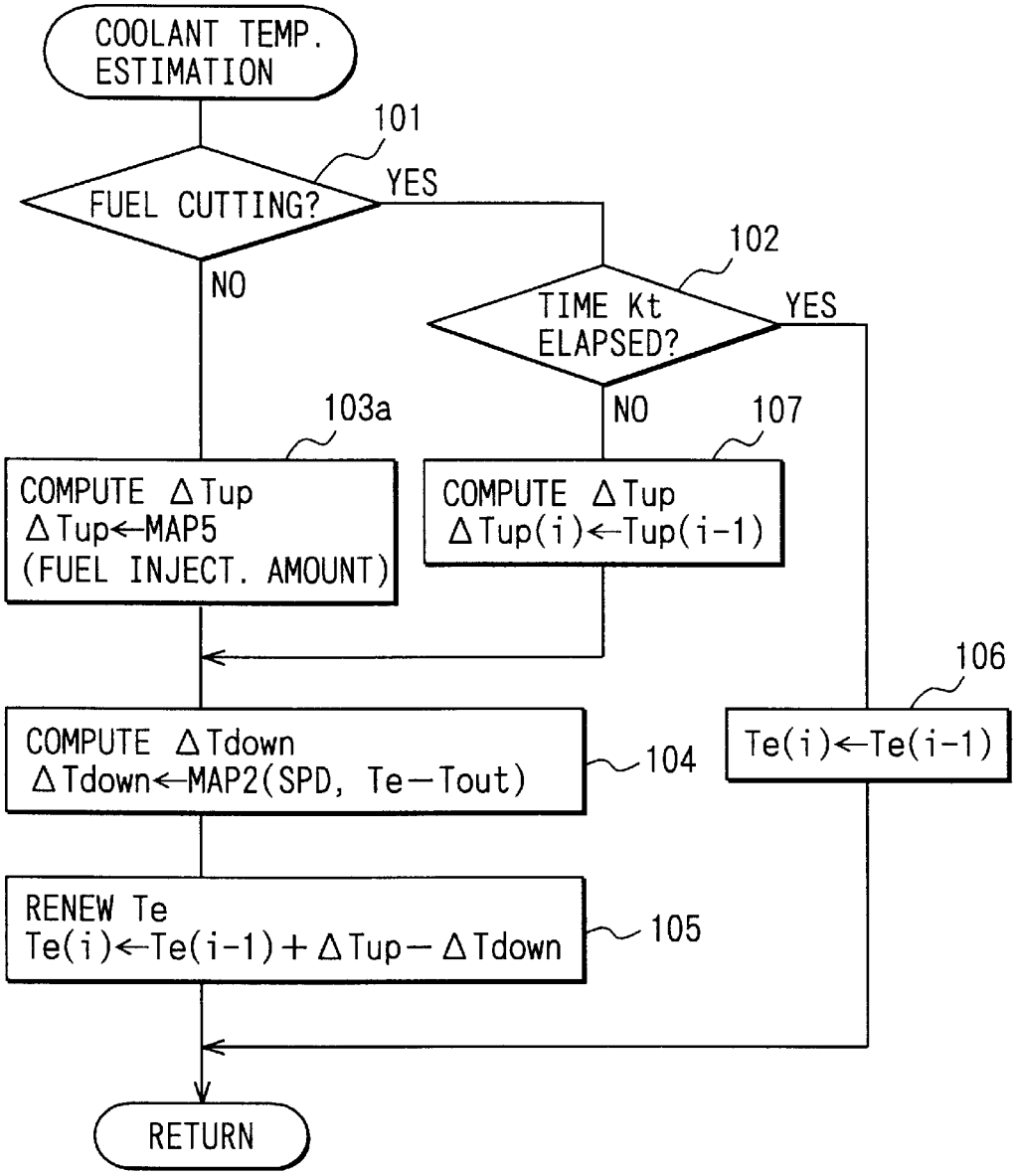
FIG. 8 is a flow chart showing a coolant temperature estimation program according to a fourth embodiment of the present invention.

In a fourth embodiment of the present invention, the estimated coolant temperature value Te is renewed by executing a coolant temperature estimation program shown in FIG. 8. The coolant temperature estimation program of FIG. 8 is similar to that of the coolant temperature estimation program discussed in the first embodiment with reference to FIG. 2 except that step 103 is replaced with step 103*a,* and step 107 is added after step 102.

In the fourth embodiment, a map MAP5, which shows the net coolant temperature increase ΔTup in relation to the fuel injection amount, is stored in the ROM (memory) of the ECU 24 as a map for computing the net coolant temperature increase ΔTup. If it is determined that the fuel cutting operation is not currently carried out at step 101, control moves from step 101 to step 103*a*. At step 103*a,* the net coolant temperature increase ΔTup is computed using the map MAP5 based on the fuel injection amount, which is the engine operating parameter relevant to the amount of the heat generated from the engine 11.

On the other hand, if it is determined that the fuel cutting operation is currently carried out at step 101, control moves from step 101 to step 102. At step 102, it is determined whether the predetermined time period Kt has elapsed since the initiation of the fuel cutting operation. If it is determined that the predetermined time period Kt has not elapsed at step 102, control moves to step 107. At step 107, the net coolant temperature increase ΔTup is maintained at the value of the net coolant temperature increase computed just before the initiation of the fuel cutting operation (the net coolant temperature increase computed based on the fuel injection amount just before the initiation of the fuel cutting operation using the map MAP5).

As described above, once the net coolant temperature increase ΔTup is computed at step 103*a* or 107, control moves to step 104. Similar to the first embodiment, the net coolant temperature decrease ΔTdown is computed using the two dimensional map MAP2 based on the vehicle speed SPD and the temperature difference (Te−Tout) between the estimated coolant temperature value Te and the external air temperature Tout. Then, control moves to step 105. At step 105, the currently estimated coolant temperature value Te(i) is obtained by adding the net coolant temperature increase ΔTup to the previously estimated coolant temperature value Te(i−1) and then subtracting the net coolant temperature decrease ΔTdown from the sum of the previously estimated coolant temperature value Te(i−1) and the net coolant temperature increase ΔTup.

As described above, the fuel injection amount is the engine operating parameter relevant to the amount of the heat generated from the engine (i.e., the amount of the heat conducted from the engine 11 to the coolant). The fourth embodiment is based on this fact, and the net coolant temperature increase ΔTup is estimated based on the fuel injection amount. Thus, the net coolant temperature increase ΔTup, which is induced by the heat generated from the engine 11, is more accurately estimated, and thus the estimated coolant temperature Te is more accurately estimated.

Furthermore, the net coolant temperature increase ΔTup during the fuel cutting operation becomes greater as the engine temperature at the beginning of the fuel cutting operation gets higher. Also, the engine temperature at the beginning of the fuel cutting operation increases as the fuel injection amount before the fuel cutting operation increases. Based on these points, the net coolant temperature increase ΔTup is estimated based on the fuel injection amount, which is measured just before the initiation of the fuel cutting operation, during the predetermined time period Kt upon the initiation of the fuel cutting operation. Thus, the estimated coolant temperature Te during the fuel cutting operation can be more accurately computed.

In the fourth embodiment, the net coolant temperature increase ΔTup is maintained at the value of the net coolant temperature increase, which is computed just before the initiation of the fuel cutting operation (the net coolant temperature increase computed based on the fuel injection amount just before the initiation of the fuel cutting operation), during the predetermined time period Kt upon the initiation of the fuel cutting operation. However, this can be modified based on the fact that the increase in the coolant temperature is gradually reduced with time after the initiation of the fuel cutting operation. That is, the net coolant temperature increase ΔTup can be corrected until the predetermined time period Kt elapses after the initiation of the fuel cutting operation in such a manner that the net coolant temperature increase ΔTup is gradually reduced from the value of the net coolant temperature increase, which is computed just before the initiation of the fuel cutting operation.

Furthermore, in the fourth embodiment, the net coolant temperature increase ΔTup is estimated based only on the fuel injection amount. However, in order to further improve the estimation accuracy of the net coolant temperature increase ΔTup, the net coolant temperature increase ΔTup can be estimated based on other parameters besides the fuel injection amount. These additional parameters can include the engine speed and/or the engine load (e.g., the intake pipe pressure, the amount of the intake air, the throttle valve position and the like). In essence, it is only required to estimate the net coolant temperature increase ΔTup based on the at least one parameter, which is relevant to the amount of the heat generated from the engine.

The estimated coolant temperature value Te, which is estimated by the method discussed in any one of the first to fourth embodiments, is used for the abnormality judgment of the thermostat but can be used in abnormality judgment of the coolant temperature sensor 22 and/or abnormality judgment of warming up of the engine 11. In the case of the abnormality judgment of the coolant temperature sensor 22, when a predetermined abnormality judgment executable condition is satisfied, the abnormality of the coolant temperature sensor 22 can be judged by determining whether a difference between the estimated coolant temperature value Te and the actual coolant temperature Thw (measured value of the coolant temperature 22) is greater than an abnormality judgment threshold value. In the case of abnormality judgment of the warming up of the engine 11, when a predetermined abnormality judgment executable condition is satisfied, the abnormality of the warming up of the engine 11 can be judged by determining whether the difference between the estimated coolant temperature value Te and the actual coolant temperature Thw (measured value of the coolant temperature sensor 22) is greater than an abnormality judgment threshold value.

Furthermore, in each one of the first to fourth embodiments, alternative to the map MAP1-MAP5, a corresponding formula can be used.

Additional advantages and modifications will readily occur to those skilled in the art. The invention in its broader terms is therefore, not limited to the specific details, representative apparatus, and illustrative examples shown and described.

What is claimed is:

1. A coolant temperature estimation system for estimating a temperature of coolant of an internal combustion engine, the system comprising:

a coolant temperature estimating means, which renews an estimated coolant temperature value based on an operating state of the internal combustion engine during operation of the internal combustion engine; and an estimated coolant temperature correcting means, which corrects the estimated coolant temperature value in such a manner that an increase in the estimated coolant temperature value is progressively reduced as a function of time elapsed since initiation of a fuel cutting operation during the fuel cutting operation.

2. A coolant temperature estimation system for estimating a temperature of coolant of an internal combustion engine, the system comprising:

a coolant temperature estimating means, which renews an estimated coolant temperature value based on an operating state of the internal combustion engine during operation of the internal combustion engine, wherein the coolant temperature estimating means includes a fuel cutting period coolant temperature estimating means, which computes the estimated coolant temperature value during a fuel cutting operation, and wherein the fuel cutting period coolant temperature estimating means is selected and used during the fuel cutting operation to renew the estimated coolant temperature value in such a manner that an increase in the estimated coolant temperature value during the fuel cutting operation is reduced in comparison to an increase in the estimated coolant temperature value during a normal operation.

3. A coolant temperature estimation system for estimating a temperature of coolant of an internal combustion engine, the system comprising:

a coolant temperature estimating means, which renews an estimated coolant temperature value based on an operating state of the internal combustion engine during operation of the internal combustion engine; and a coolant temperature estimation prohibiting means, which prohibits renewal of the estimated coolant temperature value upon elapse of a predetermined time period since initiation of a fuel cutting operation until end of the fuel cutting operation.

4. A coolant temperature estimation system according to claim 3, wherein the coolant temperature estimation prohibiting means sets the predetermined time period based on at least one of an engine temperature of the internal combustion engine and a vehicle speed.

5. A coolant temperature estimation system according to claim 3, wherein:

the internal combustion engine is provided with a thermostat and a coolant temperature sensor; and the coolant temperature estimation system further comprises an abnormality detecting means, which detects at least one of abnormality of the thermostat, abnormality of the coolant temperature sensor and abnormality of warming up of the internal combustion engine based on a difference between the estimated coolant temperature value and a corresponding measured value of the coolant temperature sensor.

6. A coolant temperature estimation system according to claim 3, wherein the coolant temperature estimating means computes the estimated coolant temperature value based on at least one of an engine speed, an engine load and a fuel injection amount of the internal combustion engine.

7. A coolant temperature estimation system according to claim 3, wherein:

the coolant temperature estimating means computes the estimated coolant temperature value based on a fuel injection amount of the internal combustion engine; and the coolant temperature estimating means computes the estimated coolant temperature value based on the fuel injection amount, which is measured before the initiation of the fuel cutting operation, upon the initiation of the fuel cutting operation until the end of the predetermined period.

8. A coolant temperature estimation system according to claim 3, wherein:

the coolant temperature estimating means computes a net coolant temperature increase based on at least one engine operating parameter, which is relevant to an amount of heat generated from the internal combustion engine;

the coolant temperature estimating means computes a net coolant temperature decrease based on at least one engine operating parameter, which is relevant to an amount of heat released from the coolant; and the coolant temperature estimating means renews the estimated coolant temperature value by computing a currently estimated coolant temperature value, wherein the currently estimated coolant temperature value is computed by adding the net coolant temperature increase to a previously estimated coolant temperature value and then subtracting the net coolant temperature decrease from a sum of the previously estimated coolant temperature value and the net coolant temperature increase.

9. A coolant temperature estimation system according to claim 8, wherein:

the at least one engine operating parameter, which is relevant to the amount of the heat generated from the internal combustion engine, includes an engine speed and an intake pipe pressure; and the at least one engine operating parameter, which is relevant to the amount of the heat released from the coolant, includes a vehicle speed and a temperature difference between the previously estimated coolant temperature value and an external air temperature.

10. A coolant temperature estimation system according to claim 8, wherein the coolant temperature estimating means outputs the previously estimated coolant temperature value, which is estimated just before the initiation of the fuel cutting operation, as the currently estimated coolant temperature value after the predetermined time period during the fuel cutting operation.

* * * * *